US006315511B1

(12) United States Patent
Taube

(10) Patent No.: US 6,315,511 B1
(45) Date of Patent: Nov. 13, 2001

(54) METHOD AND APPARATUS FOR COINING END PANELS OF CONTAINERS

(76) Inventor: William L. Taube, 6713 Sylvian, NW., North Canton, OH (US) 44720

( * ) Notice: Subject to any disclaimer, the term of this patent is extended or adjusted under 35 U.S.C. 154(b) by 0 days.

(21) Appl. No.: 09/352,638

(22) Filed: Jul. 15, 1999

(51) Int. Cl.[7] ..... B21D 51/44
(52) U.S. Cl. ..... 413/17; 413/8; 413/15
(58) Field of Search ..... 413/8, 12, 15, 413/17, 67, 55

(56) References Cited

U.S. PATENT DOCUMENTS

| | | | |
|---|---|---|---|
| 4,361,251 | 11/1982 | Langseder et al. | 220/269 |
| 4,367,996 | 1/1983 | Saunders | 413/14 |
| 4,381,064 | 4/1983 | Das et al. | 220/458 |
| 4,386,713 | 6/1983 | Baumeyer et al. | 220/269 |
| 4,394,927 | 7/1983 | Zysset | 220/273 |
| 4,397,403 | 8/1983 | Guimarin | 220/269 |
| 4,452,375 | 6/1984 | Marcus | 220/458 |
| 4,457,450 | 7/1984 | Smith et al. | 220/455 |

*Primary Examiner*—Peter Vo
*Assistant Examiner*—Louis K. Huynh
(74) *Attorney, Agent, or Firm*—Renner, Kenner, Greive, Bobak, Taylor & Weber

(57) ABSTRACT

A method of coining the score line of container end panels having displaceable portions includes holding a portion of the end panel and coining the score line area thereof between the tapered peripheral edges of the ends of a coining punch and a coining die while controlling the flow of material from the coined area. The apparatus includes a pressure sleeve for engaging a portion of the end panel against the top of the coining die, a control die for supporting the remainder of the end panel and a coining punch for engaging the end panel in the area to be scored. The coining punch and coining die are provided with tapered or beveled shoulders which cooperate to coin the metal therebetween.

18 Claims, 3 Drawing Sheets

METHOD AND APPARATUS FOR COINING END PANELS OF CONTAINERS

RELATED PATENT APPLICATIONS

None.

1. Field of the Invention

This invention relates in general to the forming of end panels for food and beverage containers and relates in particular to a method and apparatus for coining the end panel thereof, particularly with regard to easy-open containers.

2. Background of the Invention

In the container industry, the so-called easy-open container is well known. These containers, whether two- or three-piece, consist of a top end panel which has a displaceable panel and, generally, a finger-engaging ring or lever tab affixed to the end panel which can be engaged or grasped by the finger so that lifting of the tab about its point of affixation causes the displaceable panel to fracture about a score line and provide an opening in the end closure for access to the contents after removal of the displaceable panel. In many instances, the tab can be formed integrally with the displaceable panel so that the displaceable panel is not totally removed but folded inwardly to provide an opening, but here, too, the juncture between the displaceable panel and the end panel per se is characterized by a score line which facilitates separation. It is well known that this general principle of operation and design can be employed with either full or partial openings, and regardless of whether the displaceable panel is fully or partially separated from the end panel. In general, these are designed for easy opening by the user without the utilization of any implement such as a can opener.

Examples can be seen in Langseder U.S. Pat. Nos. 4,361,251; Saunders 4,367,996; Baumeyer 4,386,713; Zysset 4,394,927; and Guimarin 4,397,403.

In the prior art, as previously noted, it is known to provide the end panel with a score or severing line about the periphery or at least part of the periphery of the displaceable panel so that it will fracture easily upon activation of the tab. Of necessity, forming the score line is a delicate operation inasmuch as the material from which these containers are formed is generally in the nature of 0.010 of an inch thick and the score line must be sufficiently deep to enable easy separation of the displaceable panel from the remainder of the container end while retaining sufficient strength to contain the contents of the container, which is often filled under pressure, in order to prevent premature rupture of the end and thereby leakage or spoilage of the contents.

In the prior art, it has been known to offset the main surface of the container end panel per se from the displaceable panel by raising and/or depressing at least a portion of the perimeter surface of the displaceable panel above the plane of the top surface, thus creating an offset. This offset reduced the deformation of the score line caused by the residual stress after the scoring operation. That is, when the scoring knife was retracted, there was a tendency for the metal to flow back to the scored area and deform it. Usually, it has been attempted to compensate for this by providing a bulge or raised area spaced from the score line to compensate for this flow. However, there was a serious lack of precision with this method. This is generally accomplished in a press with a punch and die and presents a radiused transition surface between the depressed displaceable panel and the remainder of the top panel.

Also, these containers are generally fabricated from steel or aluminum and additional problems are encountered in connection with providing the score both during and after the scoring operation. Specifically, steel containers in general are coated on both sides with a thin plastic coating because it is generally considered desirable to separate the contents of the container from the metal or other material from which it is fabricated. Examples of these coatings can be seen in Das U.S. Pat. Nos. 4,381,064; Marcus 4,452,375; and Smith 4,457,450.

The difficulty is that, in creating the score, the coating is often perforated or broken, thereby defeating its purpose. This generally occurs because of the high tooling pressures required to displace the material creating the score line and because this is fabricated around a radiused corner of the periphery of the punch and the die. Also, generally, the end panel is held between the punch and the die and a scoring tool is pressed into the panel in the appropriate area. However, the metal displaced in this manner tends to flow away from the score area and, when the holding pressure is released, tends to flow back due to the residual stresses thus created, again often causing distortion.

It has been found that, by coining this critical area, applying pressure over a larger surface area, and controlling the metal flow, the operation can be performed providing the necessary offset without disturbing the coating or distorting the finished product.

SUMMARY OF THE INVENTION

It accordingly becomes a principal object of the invention to fabricate a container end with a full or partial removable panel and having an offset portion in its surface which includes the displaceable panel by coining the transition area between the normal plane of the container end and the displaceable panel surface.

It has been found that this and other objects of the invention can be facilitated by providing a coining die having a flat surface at the juncture of the die top and side periphery disposed at an angle between its top surface and its side surface and providing a mating tooling punch having a complemental edge surface about its periphery, again between its end and side surfaces.

It has further been found that the objects of the invention can be facilitated by providing a pressure pad which will engage a first portion of the top surface and hold it against the top of the coining die, engaging the remainder of the top surface of the container end, i.e., the displaceable panel portion, with a coining punch which holds it against the top of a control die. As noted, the periphery of the coining punch and the coining die can be provided with chamfered or angled peripheral edges which, when the press is in the closed position, are disposed in juxtaposed relationship to each other.

In this fashion, the metal flow can be controlled and the integrity of the coating can be preserved by directing the metal being displaced into a contained area.

The method of operation of the invention includes positioning the end panel on the coining die and the control die and engaging the first portion of the top surface of the panel with a pressure pad and engaging the remainder with a tooling punch. This is achieved by coining an area of the top surface of the panel between the peripheral edges of the coining punch and the coining die while holding the remaining end portions so as to compress the metal and thin it.

Accordingly, production of an improved method and apparatus for forming an end panel for a container becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 7:
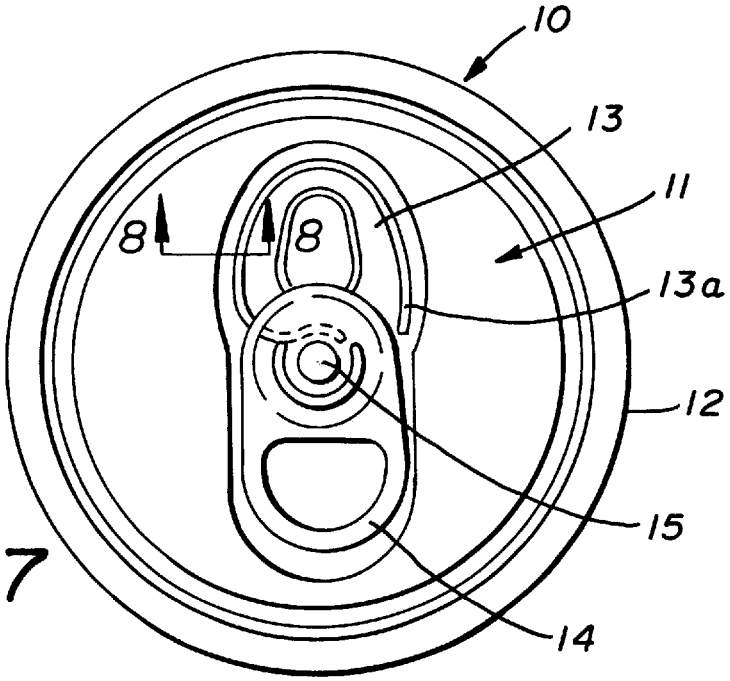
FIG. 7 is a top plan view of the finished end panel.
Figure 8:
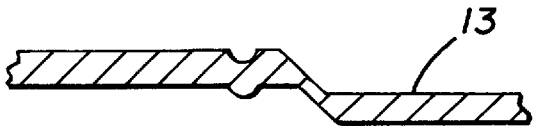
FIG. 8 is a sectional view taken along the line 8—8 of FIG. 7.

Referring first to FIG. 7 of the drawings for a description of the end panel itself, it will be noted that the end panel, generally indicated by the numeral 10, includes a top surface 11 and a periphery 12. In the form of the invention illustrated in the drawings, a displaceable panel 13 and a tab 14 are also provided with the tab being affixed to the top surface 11 by the rivet 15. The illustrated displaceable panel 13 is generally U-shaped and has at least a partial score line 13*a* by which it is joined to the remainder of the end panel 10.

In that regard, and as previously noted, it will be noted that one particular type of easy-open container end panel is illustrated in the drawings and will be described herein. It should also be understood that the principles of the invention would be applicable to any other type of "easy-open" end panel and would include a full removable end panel and regardless of whether the displaceable panel is intended to be retained attached to the end after separation or not.

Figure 1:
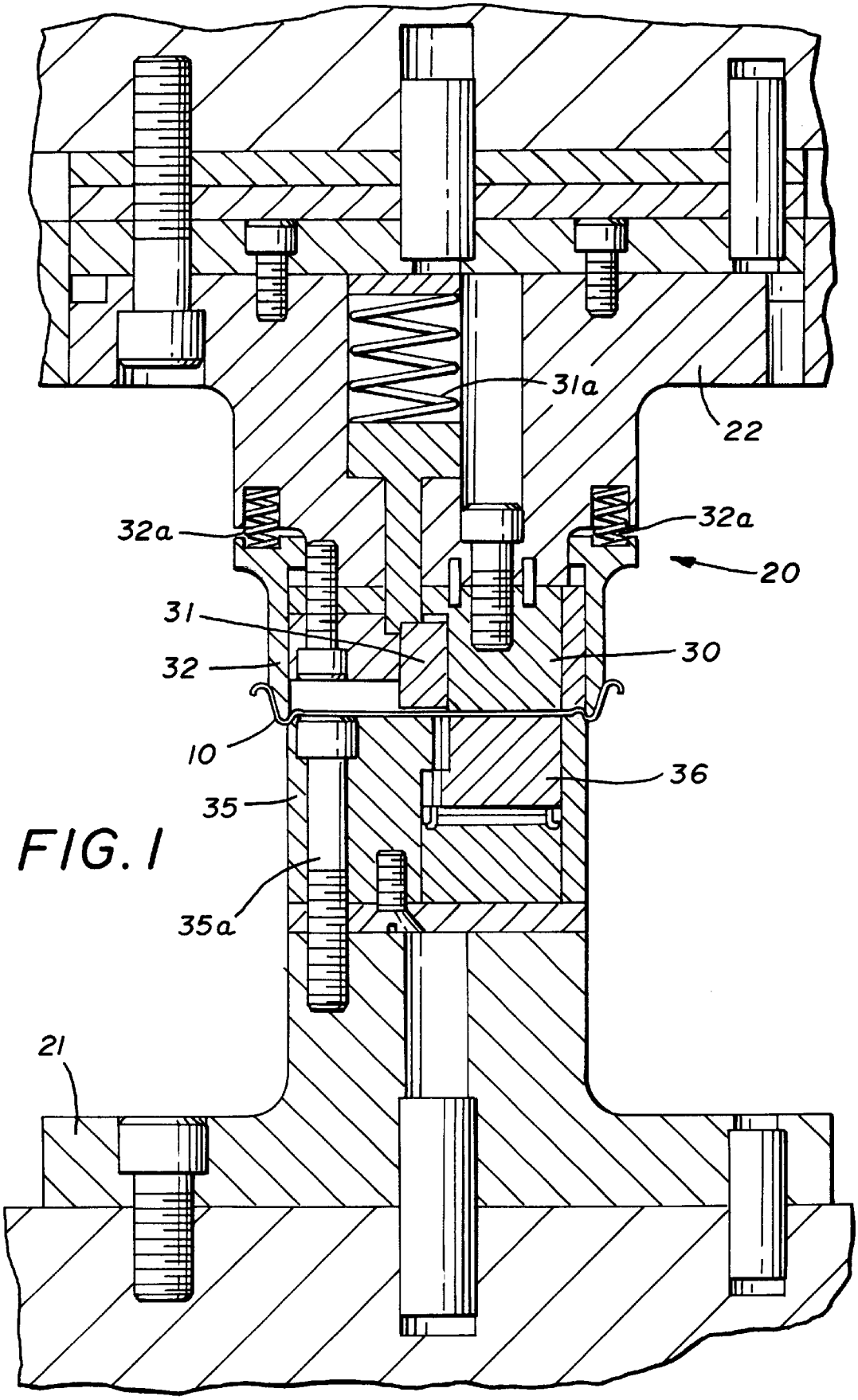
FIG. 1 is a sectional elevational view showing the overall tooling apparatus for the invention disposed in a conventional forming press.

Turning then to FIG. 1 of the drawings, it will be seen that the press in which the tooling for the practice of the invention is utilized is generally indicated by the numeral 20 and includes a base 21 and a movable upper platen 22.

Carried by the press 20 is the tooling for effectuating the method of the invention.

This tooling includes a coin punch core 30 secured to the upper platen 22 of the press. It also includes a pressure sleeve 31, also secured to the top platen for movement therewith and engaged by spring 31*a*, and a second pressure sleeve 32 which is urged toward the base of the press by the springs 32*a*.

Fixed to the base 21 of the press is a coining die 35 held thereon by screws 35*a*. A control die 36 is also secured to the base of the press outboard of coining die 35. In the embodiments illustrated herein and described, the coining die 35 and the control die 36 are illustrated as separate pieces. It is, of course, possible that they could be formed from one piece of metal.

Figure 2:
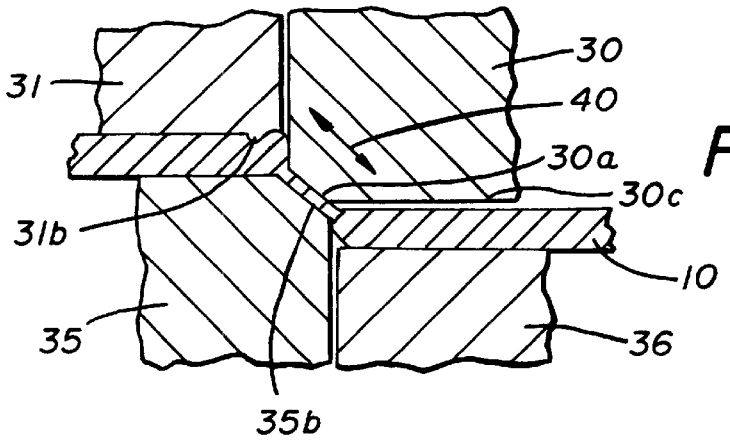
FIG. 2 is an enlarged sectional view showing one form of the invention in the closed position.

Turning to FIG. 2 of the drawings, it will be seen that the first pressure sleeve 31 carries a stinger 31*b* which engages the top of the container end panel 10 and holds it against the top of the coining die 35 in conjunction with second pressure sleeve 32. In this form of the invention, as noted, the bottom surface of the pressure pad contains one or more projections or "stingers" 31*b*. These are intended to insure that the end panel 10 is securely held against lateral or radial movement during the coining operation.

The remaining surface area of the container end panel 10 is disposed between the bottom of the coining punch 30 and the top of control die 36. It will be noted that when the press closes, the space between the bottom of coining punch 30 and the top of control die 36 is slightly greater than the thickness of the end. Preferably, this gap is not more than 105 percent of the thickness of the end panel. This provides some room for the metal displaced by the coining operation to flow in a controlled manner as the material is thinned in the score line area. It is important to provide this and to control the flow. If totally clamped in this area, the material will tend to be forced against the corner of the coining die and which can lead to fracturing of the plastic coating on the end panel material. On the other hand, if there is no restraint at all, the final thickness of the thinned area cannot be controlled.

It will be noted that a flat surface or chamfer 30*a* is provided about the periphery of the coining punch and complemental flat surface 35*b* is provided about the periphery of the coining die 35 at the intersections of their ends and sides so that, when the top platen 22 of the press 20 forces the tooling members, including the coining punch 30 and the pressure pad, downward toward the coining die 35 and the control die 36, the stinger or projection 31*b* will engage the top surface of the end panel 10 and prevent lateral or radial movement and, as pressure is increased, the material between the flat edges of the coin punch 30 and the coin die 35 will be squeezed or coined so as to thin it.

When this occurs, the metal between surfaces 30*a* and 35*b* will tend to flow in the direction of arrow 40. Stinger 31*b* will inhibit this flow in one direction, but it will be noted that the bottom 30*c* of coining punch 30 remains spaced from the material permitting some metal flow in the opposite direction. This relatively free flow also prevents back flow from the residual stress forces previously mentioned and, thus, deformation in the scored area.

While the invention is not intended to be limited to a specific angle for the flat surfaces 30*a* and 35*b*, it has been found that an angle of approximately 45° produces satisfactory results.

Figure 3:
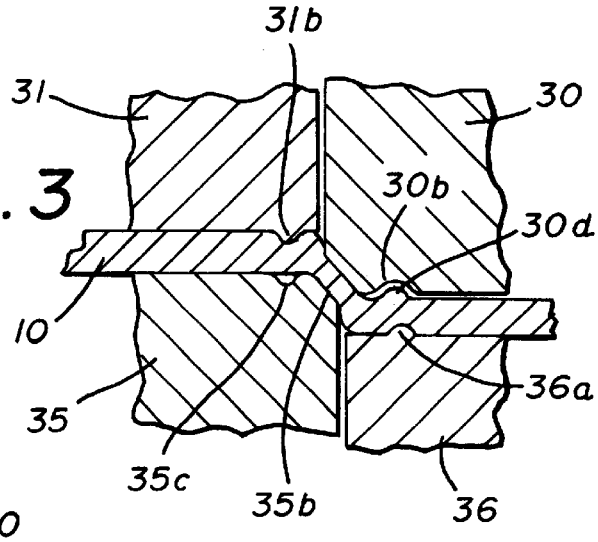
FIG. 3 is a view similar to FIG. 2 showing a modified form of the invention.

FIG. 3 shows a similar arrangement with the tooling slightly modified in that the stinger or projection projecting from the bottom of the coining punch 30 faces an opposed depression 35*c* in the top of coin die 35 so as to provide some space for any metal displaced by the stinger to migrate. Likewise, the top surface of the control die 36 contains a similar stinger or projection 36*a* and the bottom surface of the coin punch 30 also has a depression 30*b*. Naturally, these arrangements could be reversed and the stinger could be disposed on the lower tooling members and the depressions on the upper.

The stinger arrangement also provides a safety factor. In normal operation with the end panel material in place, the stinger 31*b* would merely engage the top surface of the material in FIGS. 2, 3 and 5. The depressions 30*b*, 35*c* and 36*a* may be provided so that if the press is operated without any material in place for any reason, the stingers would be received therein, avoiding damage to the top surface of the coining die 35 or bottom surface of the coining punch 30 as the case may be.

Figure 4:
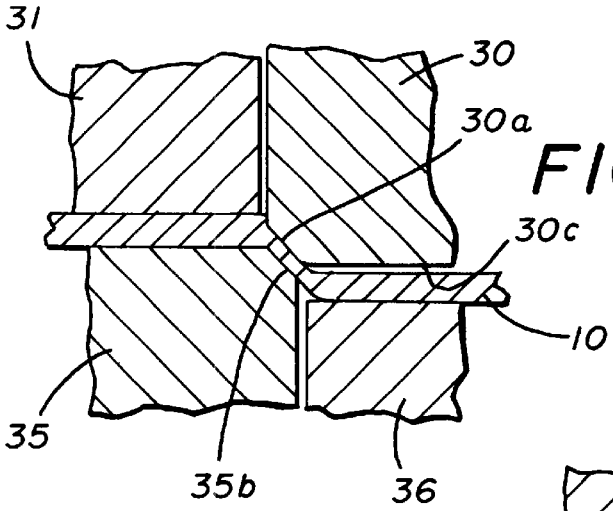
FIG. 4 is a view similar to FIG. 2 showing a still further modified form of the invention.

FIG. 4 shows a similar arrangement without stingers or projections or depressions on any of the tooling members, relying simply on the flat bottom surface of the first pressure sleeve 31 and the top surface of the coin die 35 to hold the end panel 10 and the bottom surface of the coin punch 30 in cooperation with the top surface of the control die 36 to compress the metal.

Figure 5:
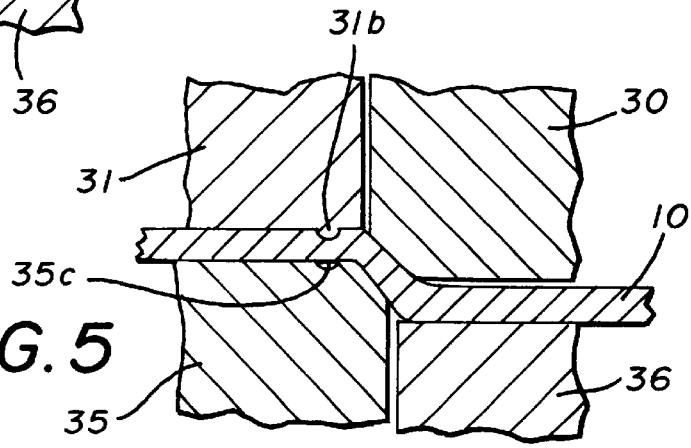
FIG. 5 is a sectional view similar to FIG. 2 showing a still further modified form of the invention.

FIG. 5 is similar to FIG. 3, showing a further modification in which the stinger and depression are contained only on the first pressure sleeve 31 and the coin die 35.

Figure 6:
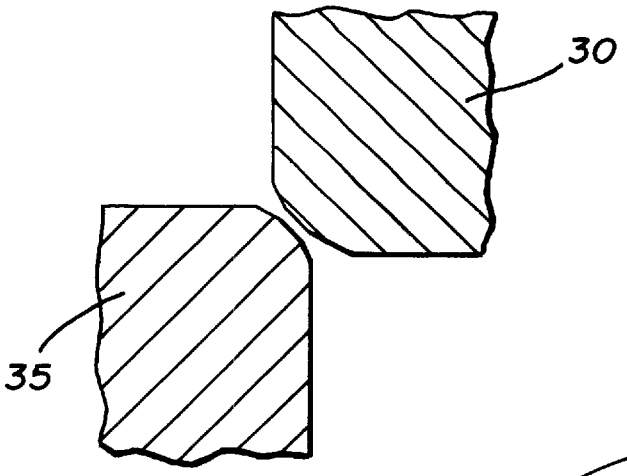
FIG. 6 is a view similar to FIG. 2 showing a still further modified form of the invention.

FIG. 6 shows a further modification in that, rather than one flat surface 30*a* angled between the side surface and the top surface of the coin die, a series of shorter flat surfaces are provided. A similar arrangement is illustrated on the bottom peripheral edge of the coining punch 30 itself. It is also contemplated that the top peripheral edge surface of coining die 35 could be radiused outwardly.

Use in operation of all forms of the invention illustrated remains essentially the same.

It will be seen that, with this arrangement, it is possible to coin a coated material such as steel or a coated laminated aluminum between either parallel or non-parallel (see FIG. 5) flat surfaces, thus squeezing and coining the metal down to the desired finished thickness without disturbing any chemical or plastic coating which may be on the material.

Following the operation just described, the end panel may be passed on to a further operation for staking or applying the rivet 15 and the pull tab 14 or, in the case of modifications, the grasping member or tab which is utilized to break the score line and separate either a part or all of the end panel for access to the contents.

While a full and complete description of the invention has been set forth in accordance with the dictates of the patent statutes, it should be understood that modifications can be resorted to without departing from the spirit hereof or the scope of the appended claims.

What is claimed is:

1. A method of forming an easy-open container end panel having a displaceable panel therein and a tab for separating the periphery of the displaceable panel from the end panel, the end panel having a top surface and a bottom surface, comprising the steps of:

a) positioning the bottom surface of the end panel on a coining die and a control die;

b) engaging a first portion of the top surface of the end panel between a pressure sleeve and the coining die;

c) engaging a second portion of the top surface of the end panel adjacent the periphery of the displaceable panel between a coining punch and the coining die while holding pressure on the first portion of the end panel whereby an area adjacent the periphery of the displaceable panel is coined; and d) leaving a third portion of the end panel outboard of the second portion substantially unrestrained during Step C.

2. The method of claim 1 wherein the edge surfaces of the coining die and the coining punch are disposed at complemental angles.

3. The method of claim 2 wherein the coining punch is spaced from the control die a distance equal to or less than 105 percent of the thickness of the end panel.

4. The method of claim 1 wherein the pressure sleeve and the coining die have complemental depressions and projections in their opposed surfaces.

5. The method of claim 1 wherein a coining punch is spaced from the control die a distance slightly greater than the thickness of the end panel during Step C.

6. A method of forming an easy-open container end panel having a displaceable panel portion, comprising the steps of:

a) positioning the end panel on a coining die and a control die;

b) holding the displaceable panel portion between a pressure pad and a coining die;

c) coining an area adjacent the periphery of the displaceable panel between the container end panel and the displaceable panel portion between the edge surface of a coining punch and the edge surface of the coining die; and d) leaving the remainder of the end panel substantially unrestrained during the coining operation.

7. The method of claim 6 wherein the edge surfaces of the coining die and the coining punch are formed with substantially complemental angles for engaging and coining the material therebetween.

8. The method of claim 7 wherein the coining punch is spaced from the control die a distance equal to or less than 105 percent of the thickness of the end panel.

9. The method of claim 6 wherein the coining die has a top surface and the displaceable panel portion is held between the pressure pad and the top surface of the coining die and the pressure pad and the top surface of the coining die have complemental depressions and projections.

10. The method of claim 6 wherein a portion of the end panel outboard of the displaceable panel portion and of the area adjacent the periphery of the displaceable panel portion is substantially unrestrained during coining.

11. The method of claim 6 wherein the coining punch is spaced from the control die a distance slightly greater than the thickness of the end panel during coining.

12. A method of forming an easy-open container end panel having a displaceable panel therein and a tab for separating the periphery of the displaceable panel from the end panel, the end panel having a top surface and a bottom surface, comprising the steps of:

a) positioning the bottom surface of the end panel on a coining die and a control die;

b) engaging a first portion of the top surface of the end panel between a pressure sleeve and the coining die;

c) engaging a second portion of the top surface of the end panel adjacent the periphery of the displaceable panel between a coining punch and the coining die while holding pressure on the first portion of the end panel whereby an area adjacent the periphery of the displaceable panel is coined; and d) the edge surfaces of the coining die and the coining punch are disposed at complemental angles.

13. The method of claim 12 wherein the pressure pad and the coining die have complemental depressions and projections in their opposed surfaces.

14. A method of forming an easy-open container end panel having a displaceable panel portion, comprising the steps of:

a) positioning the end panel on a coining die and a control die;

b) holding the displaceable panel portion between a pressure pad and a coining die;

c) coining an area adjacent the periphery of the displaceable panel between the container end panel and the displaceable panel portion between the edge surface of a coining punch and the edge surface of the coining die;

d) leaving the remainder of the end panel substantially unrestrained during the coining operation; and e) the edge surfaces of the coining die and the coining punch are formed with substantially complemental angles for engaging and coining the material therebetween.

15. The method of claim 14 wherein the panel portion is held between the pressure pad and the top surface of the coining die and the pressure pad and the top surface of the coining die have complemental depressions and projections.

16. The method of claim 14 wherein a portion of the end panel outboard of the displaceable panel portion and of the area adjacent the periphery of the displaceable panel portion is substantially unrestrained during coining.

17. The method of claim 14 wherein the coining punch is spaced from the control die a distance slightly greater than the thickness of the end panel during coining.

18. The method of claim 14 wherein the coining punch is spaced from the control die a distance equal to or less than 105 percent of the thickness of the end panel.

* * * * *